US007481010B2

(12) United States Patent
Chen

(10) Patent No.: US 7,481,010 B2
(45) Date of Patent: Jan. 27, 2009

(54) SHOE HAVING LIGHT DEVICE

(76) Inventor: Chang Ming Chen, No. 411-4, Jonsan Road, Salu Town, Taichung Hsien 43350 (TW)

( * ) Notice: Subject to any disclaimer, the term of this patent is extended or adjusted under 35 U.S.C. 154(b) by 465 days.

(21) Appl. No.: 11/388,959

(22) Filed: Dec. 28, 2005

(65) Prior Publication Data

US 2007/0144040 A1 Jun. 28, 2007

(51) Int. Cl.
*A43B 23/00* (2006.01)

(52) U.S. Cl. ..... 36/137; 362/103

(58) Field of Classification Search ..... 36/136, 36/137; 362/103
See application file for complete search history.

(56) References Cited

U.S. PATENT DOCUMENTS 2,931,893 A * 4/1960 Arias et al. ..... 36/1
3,564,232 A * 2/1971 Ellerbe et al. ..... 362/103
5,033,212 A * 7/1991 Evanyk ..... 36/137
5,052,131 A * 10/1991 Rondini ..... 36/137
5,381,615 A * 1/1995 MacMillan ..... 36/137
5,566,479 A * 10/1996 Gray et al. ..... 36/137
5,599,088 A * 2/1997 Chien ..... 362/103
5,604,999 A * 2/1997 Barker ..... 36/137
5,611,621 A * 3/1997 Chien ..... 362/84
5,746,499 A 5/1998 Ratcliffe et al. ..... 362/103
5,812,063 A * 9/1998 Weng et al. ..... 340/815.45
5,813,148 A * 9/1998 Guerra ..... 36/137
5,955,957 A * 9/1999 Calabrese et al. ..... 340/691.8
5,969,479 A * 10/1999 Wong ..... 315/200 A
2007/0201221 A1* 8/2007 Cherdak et al. ..... 362/103
2007/0211451 A1* 9/2007 Chung ..... 362/103
2007/0236915 A1* 10/2007 Chen ..... 362/103

* cited by examiner

*Primary Examiner*—Marie Patterson
(74) *Attorney, Agent, or Firm*—Charles E. Baxley

(57) ABSTRACT

A shoe includes a shoe upper disposed on top of a shoe sole, a circuit board disposed in a heel portion of the shoe sole, one or more light members disposed in the front portion of the shoe sole, one or more further light member disposed in the rear portion of the shoe upper, one or more batteries coupled to the light members for energizing the light members, and a switch coupled between the battery and the light members for controlling the light members, the switch is disposed in the heel portion of the shoe sole and arranged for being depressed and actuated by a user. A manual switch may be coupled between the battery and the light members for selectively operating the light members.

2 Claims, 6 Drawing Sheets

SHOE HAVING LIGHT DEVICE

BACKGROUND OF THE INVENTION

1. Field of the Invention

The present invention relates to a shoe, and more particularly to a shoe having a light device for being selectively actuated or operated by the foot steps of the user or actuated by a manually operated switch.

2. Description of the Prior Art

Typical shoes comprise one or more light devices attached to the shoe soles, the shoe fronts, or other positions of the shoe for generating indicating or warning lights, particularly during the dark environment, and normally comprise a manually operated switch coupled to the electric circuit of the light devices for operating or controlling the light devices.

For example, U.S. Pat. No. 2,931,893 to Gonzalez Arias et al. discloses one of the typical lighting arrangements for shoes and comprises a light device attached to the shoe front of the shoe for generating indicating or warning lights, and also comprises a manually operated switch coupled to the electric circuit of the light devices for being depressed or actuated by the user to operate or control the light devices. However, the light devices may not be controlled or operated by the foot steps of the user.

U.S. Pat. No. 5,746,499 to Ratcliffe et al. discloses another typical foot wears having a light device for attaching to a shoe and for generating pulsed lights, and having a pressure or membrane switch coupled to the electric circuit of the light devices for being depressed or actuated by the user to operate or control the light devices. However, the light devices may not be operated or energized or actuated when the user do not walk or do not depress against the shoe.

The present invention has arisen to mitigate and/or obviate the afore-described disadvantages of the conventional light devices for shoes.

SUMMARY OF THE INVENTION

The primary objective of the present invention is to provide a shoe including a light device arranged for being selectively actuated or operated by the foot steps of the user or actuated by a manually operated switch.

In accordance with one aspect of the invention, there is provided a shoe comprising a shoe sole, and a shoe upper disposed on top of the shoe sole, the shoe sole including a heel portion and a front portion, and the shoe upper including a front portion and a rear portion, a circuit board disposed in the heel portion of the shoe sole, at least one first light member disposed in the front portion of the shoe sole, at least one second light member disposed in the rear portion of the shoe upper, at least one battery coupled to the first and the second light members for energizing the first and the second light members, and a switch coupled between the battery and the first and the second light members for controlling the first and the second light members, the switch being disposed in the heel portion of the shoe sole and arranged for being depressed and actuated by a user.

The first light member is selectively disposable in the front portion of the shoe upper. A water resistive envelope may further be provided and engaged onto the second light member for preventing the second light member from being wetted and damaged by water or rain.

An electric cable may further be provided and coupled to the second light member, and a decorative covering is engaged onto the electric cable for protecting the electric cable and for preventing the electric cable from being wetted.

A manual switch may further be provided and attached to the heel portion of the shoe sole and coupled between the battery and the first and the second light members for selectively operating the first and the second light members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
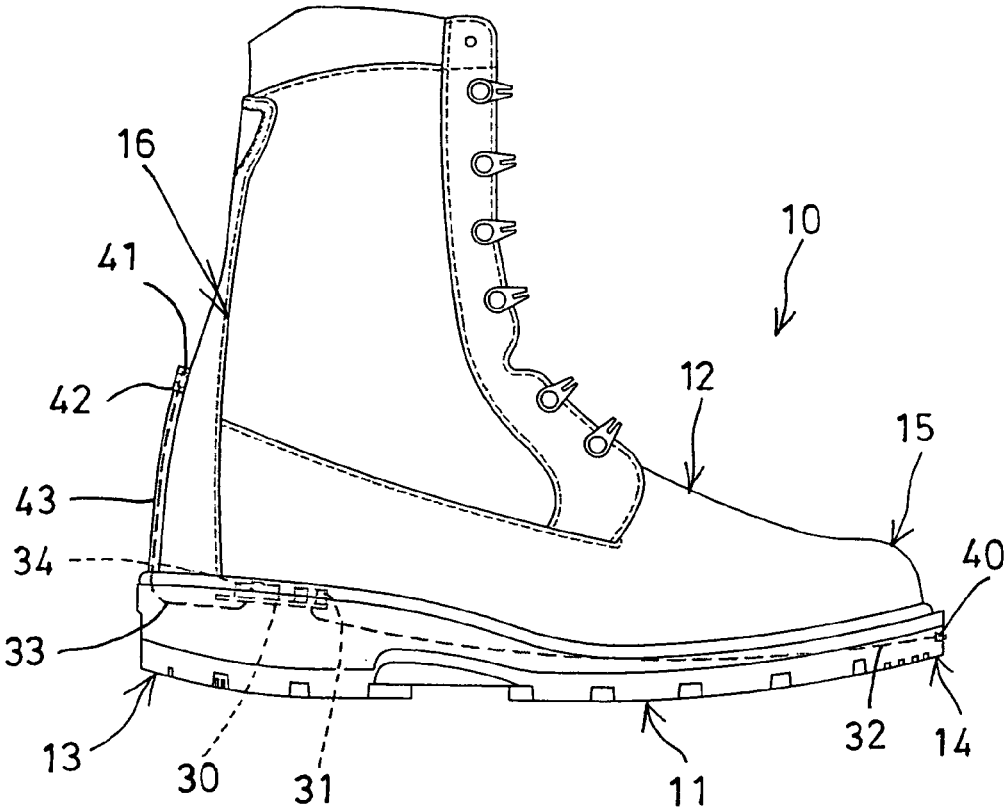
FIG. 1 is a side plan schematic view of a shoe having a light device in accordance with the present invention.
Figure 2:
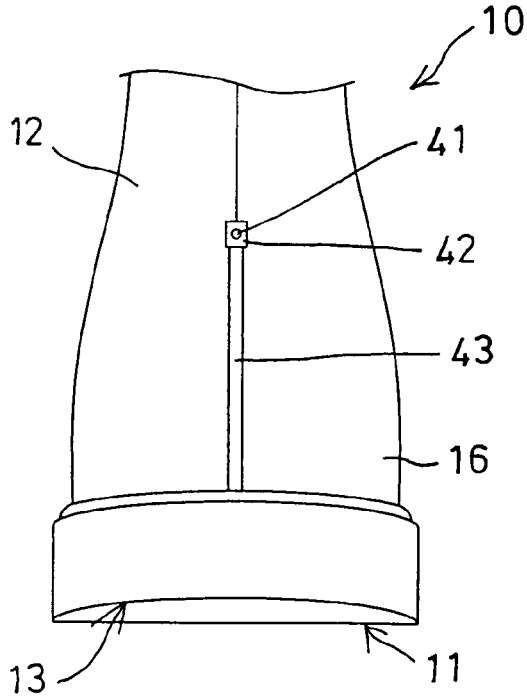
FIG. 2 is a rear plan schematic view of the shoe and the light device.
Figure 3:
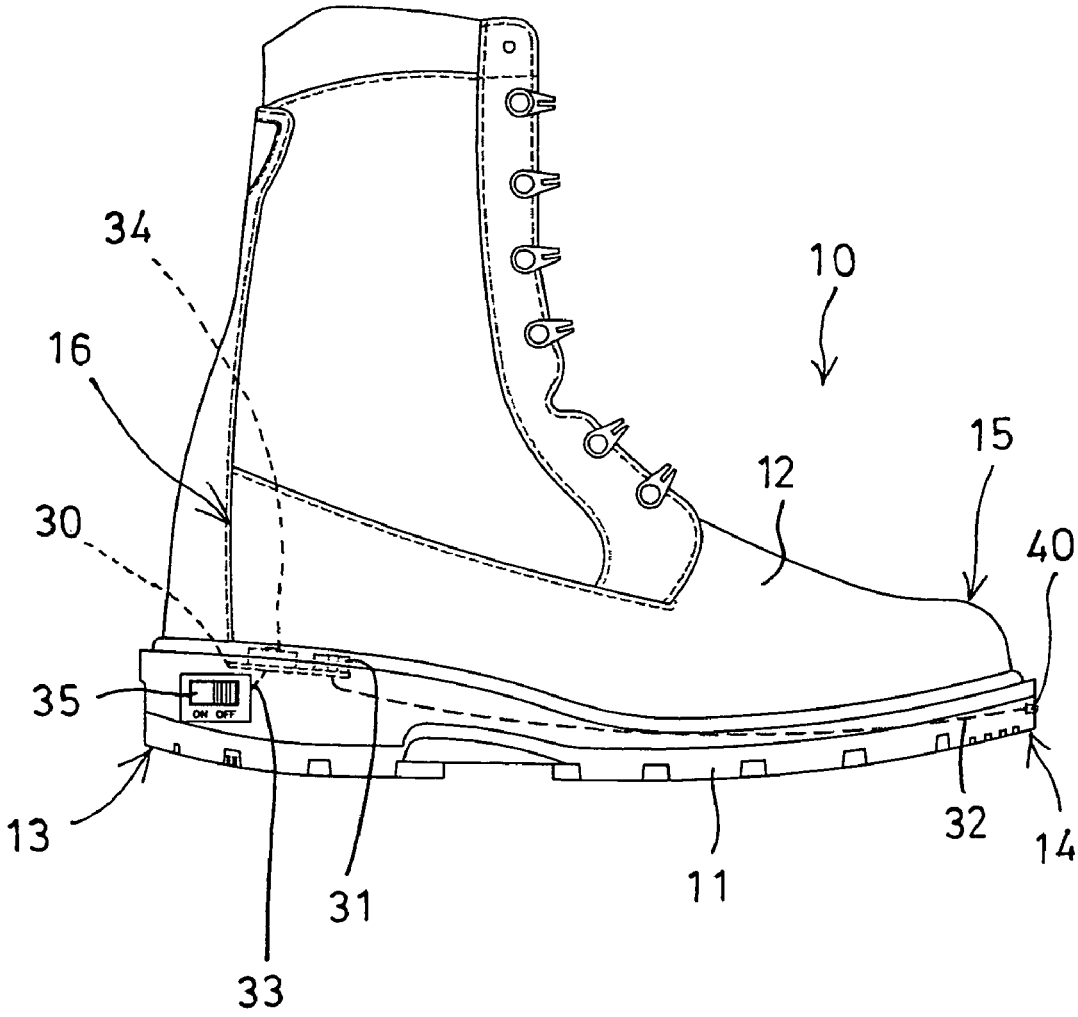
FIG. 3 is a side plan schematic view similar to FIG. 1, illustrating a manually operated switch attached to the side portion of the shoe.
Figure 4:
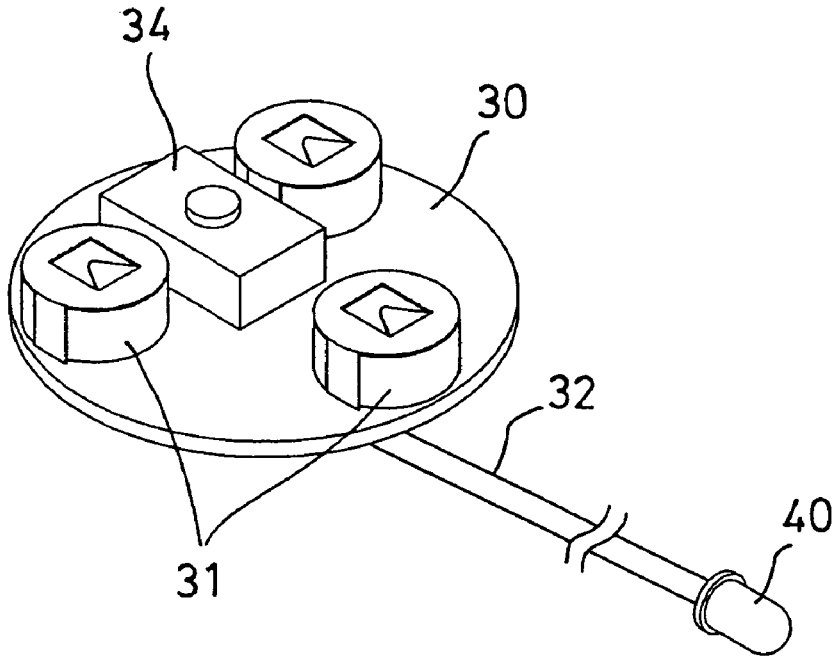
FIG. 4 is a perspective view illustrating a circuit board and a light member of the light device.
Figure 5:
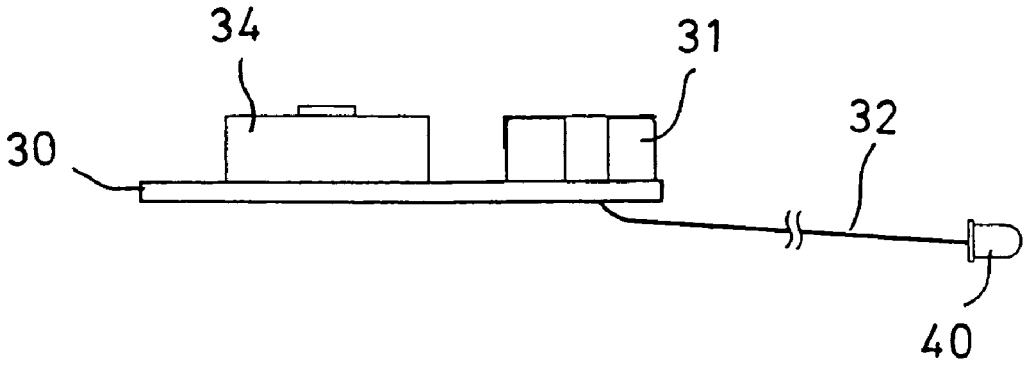
FIG. 5 is a side plan schematic view of the circuit board and the light member of the light device.
Figure 6:
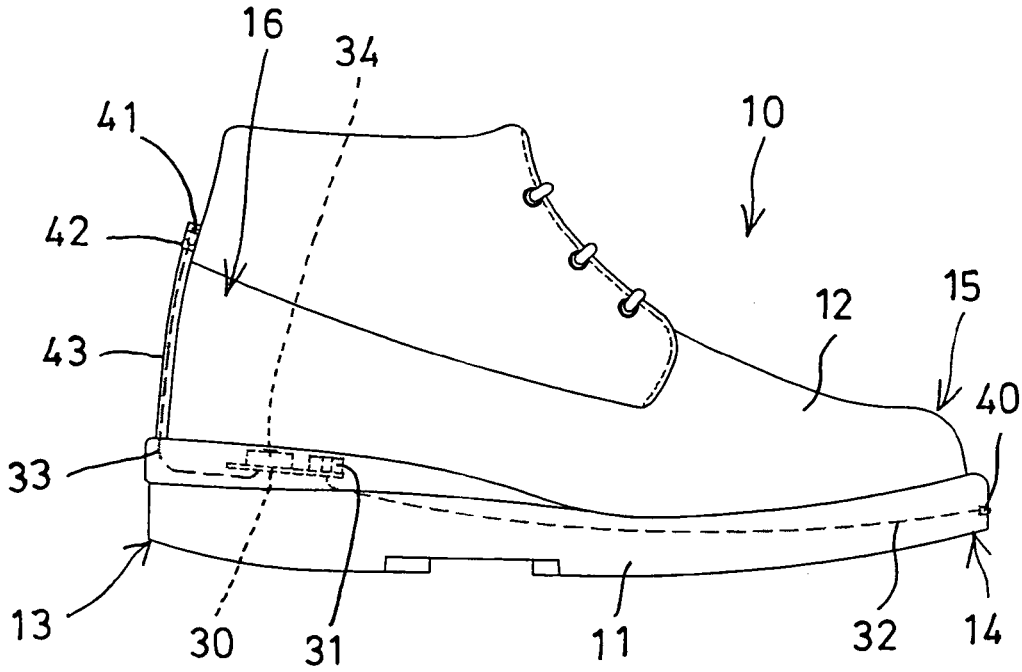
FIG. 6 is a side plan schematic view similar to FIG. 1, illustrating the other arrangement of the shoe.
Figure 7:
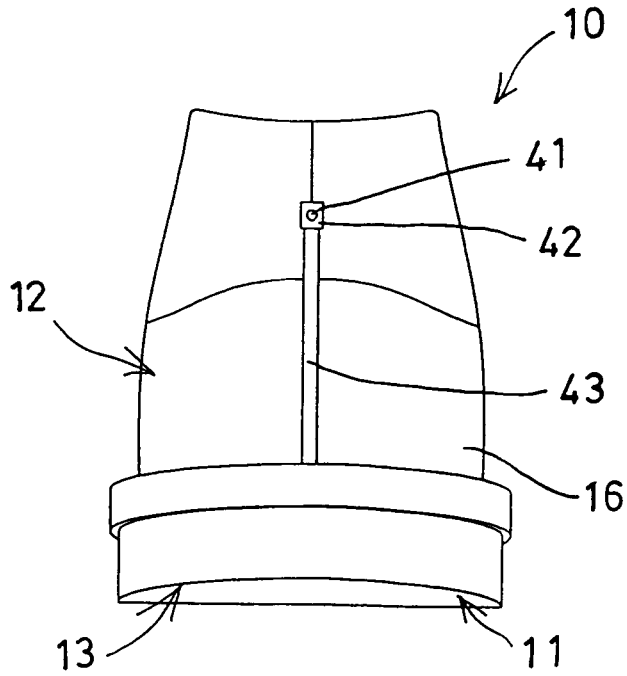
FIG. 7 is a rear plan schematic view of the shoe and the light device as shown in FIG. 6.
Figure 8:
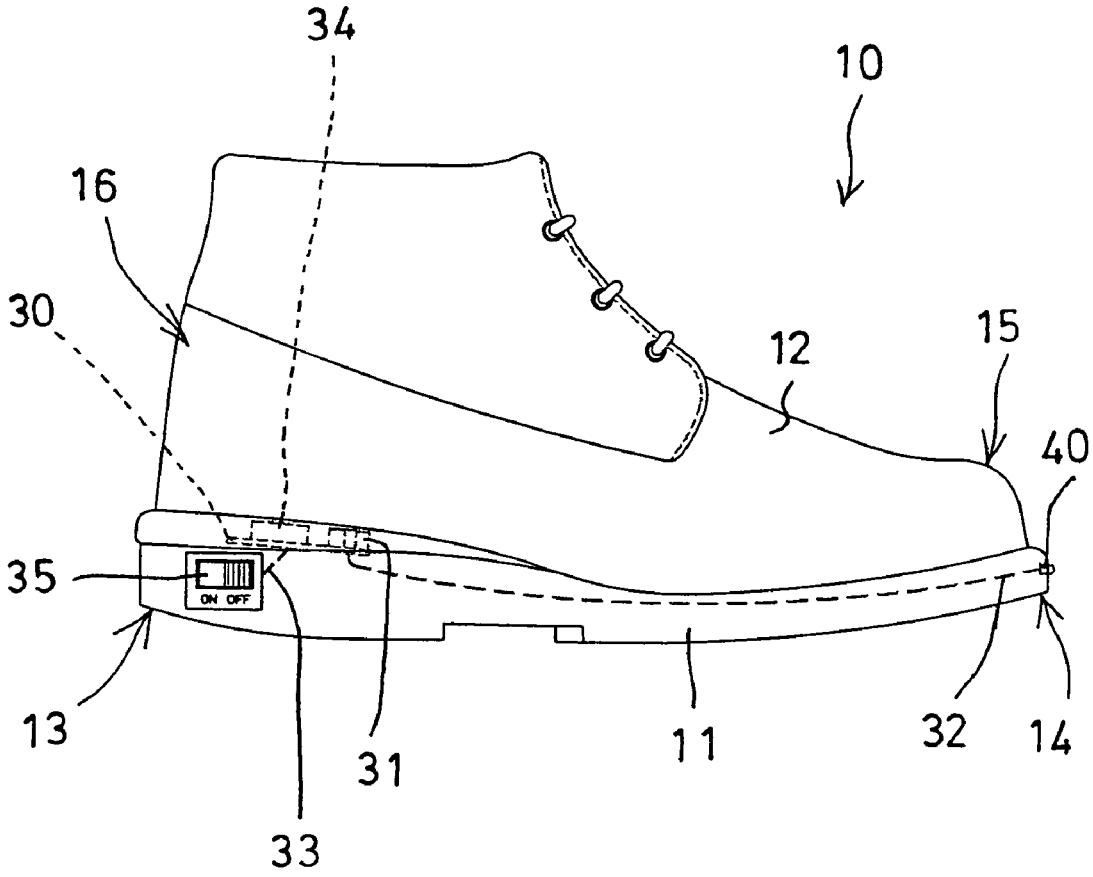
FIG. 8 is a side plan schematic view illustrating a manually operated switch attached to the side portion of the shoe as shown in FIGS. 6 and 7.
Figure 9:
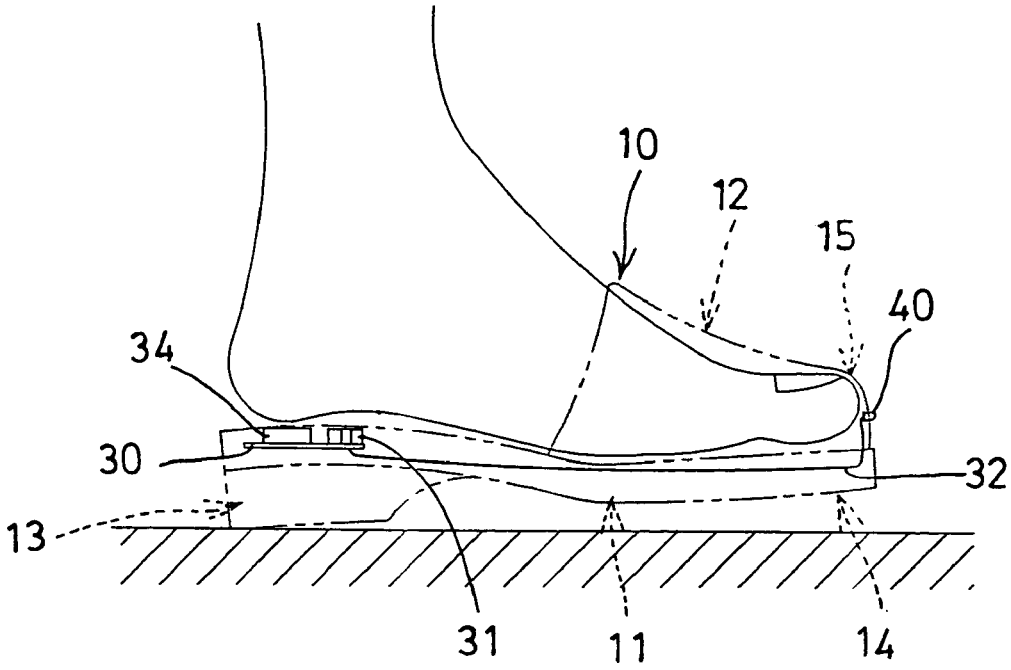
FIG. 9 is a side plan schematic view similar to FIGS. 1 and 6, illustrating the further application for the shoe.
Figure 10:
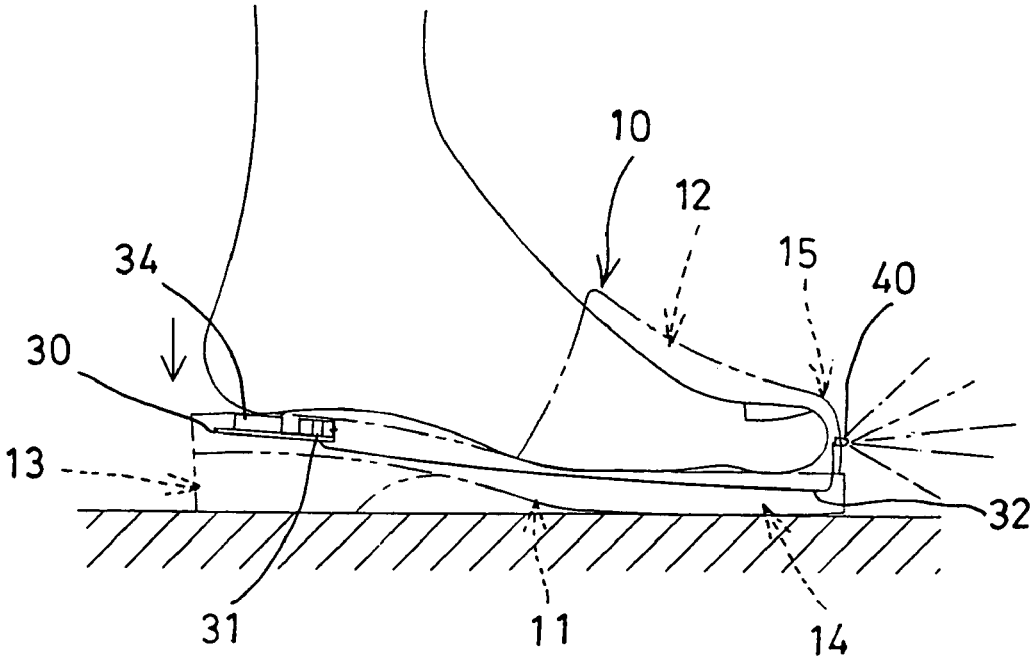
FIG. 10 is a side plan schematic view similar to FIG. 9, illustrating the operation of the shoe as shown in FIG. 9.

Referring to the drawings, and initially to FIGS. 1-5, a shoe 10 in accordance with the present invention comprises a shoe sole 11, and a shoe upper 12 disposed on top of the shoe sole 11, the shoe 10 may be selected from a boot or mountain climbing shoe as shown in FIGS. 1-3, a sports or leather or working shoe as shown in FIGS. 6-8, a slipper as shown in FIGS. 9-10, or the like.

The shoe sole 11 includes a rear or heel portion 13 having a circuit board 30 disposed or engaged therein, and a front portion 14 having one or more light members or light devices 40 disposed or engaged therein (FIGS. 1, 3, 6, 8), and the shoe upper 12 also includes a front portion 15 and a rear portion 16 for selectively attaching another light member or light device 41 (FIGS. 1-2 and 6-7). The light devices 40 may also be disposed or engaged into the front portion 15 of the shoe upper 12 (FIGS. 9-10). As shown in FIGS. 4-5, the circuit board 30 includes one or more batteries 31 disposed thereon and electrically coupled to the light members or light devices 40, 41 with electric wires or cables 32, 33 respectively for energizing the light members or light devices 40, 41, and includes a pressure or depressible switch 34 disposed thereon and coupled between the batteries 31 and the light members or light devices 40, 41 for operating or controlling the light devices 40, 41. The light devices 40, 41 may be the typical light bulbs, light emitting diodes, or other illuminating members.

For example, the pressure or depressible switch 34 is disposed or arranged in the heel portion 13 of the shoe sole 11 and arranged for being actuated or operated by the foot steps of the user. For example, when the switch 34 is depressed once by the user, the light devices 40, 41 may be arranged to be actuated or energized by the batteries 31 for a predetermined time interval, such as twenty seconds, and the light devices 40, 41 will not be actuated or energized by the batteries 31 when the switch 34 has not been depressed or actuated for the predetermined time interval, such as twenty seconds.

It is preferable that the light devices 41 are enclosed or protected by a water resistive envelope 42 for preventing the light devices 41 from being wetted or damaged by water or rain. A decorative member or covering 43 may further be provided and engaged onto the electric wire or cable 33 for protecting the electric wire or cable 33 and also for preventing the electric wire or cable 33 from being wetted or damaged by water or rain. The decorative member or covering 43 may be applied with various decorative colors or patterns thereon.

As shown in FIGS. 3 and 8, a manually operated switch 35 may further be provided and attached to such as the side portion of the heel portion 13 of the shoe sole 11 and coupled between the batteries 31 and the light members or light devices 40, 41 for selectively operating or controlling the light devices 40, 41. For example, the manually operated switch 35 is arranged to be actuated or operated manually by the user, in order to selectively operate or actuate the light devices 40, 41 to generate indicating or warning lights, particularly during the dark environment, such as the dark mine.

In operation, the switch 34 may be depressed or actuated by the user in order to operate or actuate the light devices 40, 41 to generate indicating or warning lights even when the manually operated switch 35 has not been switched or actuated by the user. The light devices 40, 41 will not be actuated or energized by the batteries 31 when the switch 34 has not been depressed or actuated or operated for the predetermined time interval, such as twenty seconds.

Alternatively, the manually operated switch 35 may be selectively switched or actuated by the user in order to operate or actuate the light devices 40, 41 continuously even when the switch 34 has not been depressed or actuated by the user. The light devices 40, 41 may be used to light both the front and the rear portions of the shoe 10 for allowing the users to safely walk in the dark environment. The shoe 10 is particularly good for or benefits the workers in the dark environment, such as miners, cave explorers, etc.

Accordingly, the shoe in accordance with the present invention includes a light device arranged for being selectively actuated or operated by the foot steps of the user or actuated by a manually operated switch.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shoe comprising:

a shoe sole, and a shoe upper disposed on top of said shoe sole, said shoe sole including a heel portion and a front portion, and said shoe upper including a front portion and a rear portion, a circuit board disposed in said heel portion of said shoe sole, at least one first light member disposed in said front portion of said shoe sole, at least one second light member disposed in said rear portion of said shoe upper, an electric cable coupled to said at least one second light member, a water resistive envelope engaged onto said at least one second light member for preventing said at least one second light member from being wetted and damaged by water, at least one battery coupled to said at least one first and said at least one second light members for energizing said at least one first and said at least one second light members, a switch coupled between said at least one battery and said at least one first and said at least one second light members for controlling said at least one first and said at least one second light members, said switch being disposed in said heel portion of said shoe sole and arranged for being depressed and actuated by a user, and a manual switch attached to said heel portion of said shoe sole and coupled between said at least one battery and said at least one first and said at least one second light members for selectively operating said at least one first and said at least one second light members.

2. The shoe as claimed in claim 1, wherein a decorative covering is engaged onto said electric cable for protecting said electric cable and for preventing said electric cable from being wetted.

* * * * *